US005695244A

United States Patent [19]

Gillern et al.

[11] Patent Number: 5,695,244

[45] Date of Patent: Dec. 9, 1997

[54] ROCKING CHAIR WITH WOOD-LAMINATED SEAT AND CONTINUOUS RUNNERS

[76] Inventors: Richard Gillern; Michelle Hare, both of 2345 Cabrillo #3, San Francisco, Calif. 94121

[21] Appl. No.: 548,412

[22] Filed: Oct. 26, 1995

[51] Int. Cl.[6] ..... A47C 3/029

[52] U.S. Cl. ..... 297/271.6; 297/411.42; 297/452.12; 297/451.3

[58] Field of Search ..... 297/271.6, 271.5, 297/451.3, 440.23, 411.42, 452.12, 452.14

[56] References Cited

U.S. PATENT DOCUMENTS

| | | | |
|---|---|---|---|
| D. 149,500 | 5/1948 | Hollander | 297/271.5 X |
| 581,975 | 5/1897 | Campbell | 297/271.6 X |
| 1,862,382 | 6/1932 | Mathis | 297/440.23 X |
| 2,303,039 | 11/1942 | Gilkinson | 297/452.12 X |
| 2,778,410 | 1/1957 | Bode | 297/411.42 X |
| 2,900,013 | 8/1959 | Hamilton | 297/271.6 |
| 3,460,866 | 8/1969 | Kessel | 297/271.5 |
| 3,815,955 | 6/1974 | Gibilterra | 297/451.3 X |
| 4,035,020 | 7/1977 | Gold | 297/271.5 |
| 4,225,181 | 9/1980 | Lock et al. | 297/271.6 |
| 4,588,227 | 5/1986 | Austin | 297/440.23 X |
| 4,595,235 | 6/1986 | Leib | 297/451.3 X |
| 5,123,702 | 6/1992 | Caruso | 297/440.22 X |
| 5,178,438 | 1/1993 | Beger | 297/271.6 |

FOREIGN PATENT DOCUMENTS

| | | | |
|---|---|---|---|
| 621213 | 8/1962 | Belgium | 297/452.14 |
| 980596 | 12/1950 | France | 297/440.23 |
| 2594665 | 8/1987 | France | 297/440.22 |
| 638984 | 11/1936 | Germany | 297/451.3 |
| 529845 | 12/1957 | Italy | 297/451.3 |
| 492675 | 9/1938 | United Kingdom | 297/452.12 |
| 638059 | 5/1950 | United Kingdom | 297/440.23 |
| 2164249 | 3/1986 | United Kingdom | 297/451.3 |

*Primary Examiner*—Peter M. Cuomo
*Assistant Examiner*—David E. Allred

[57] ABSTRACT

A chair capable of rocking and reclining is provided with a contoured seat with internal cross members and an external frame assembly for maintaining the contoured seat above the ground. The external frame assembly has a pair of spaced apart side members with a continuous outer periphery. Each of the side frame members has a large ground-contacting arcuate region that extends forward and an arm-support region that forms an armrest. The side members are coupled together by cross members and spacer elements that extend between the two. The contoured seat fits between the side members and following the lines of the cross member connection region of the side frame members. The side frame members are fixed and fastened to the spacer elements and cross members at a number of points along the frame. A user is comfortably positioned in the chair by head, back, and seat support areas of the contoured seat. The contoured seat and curvature of the arcuate regions have a relationship such that the axis of curvature of the arcuate ground-contacting region is slightly rearward of the center of gravity of an occupied chair, thereby allowing the user to comfortably change the position of the chair over a wide range of positions.

1 Claim, 6 Drawing Sheets

ROCKING CHAIR WITH WOOD-LAMINATED SEAT AND CONTINUOUS RUNNERS

DESCRIPTION

1. Technical Field

The present invention relates to chairs and more particularly to chairs capable of being rocked backward to reclining positions simply by the momentum created by the user.

2. Background Art

Various types of chairs have been developed which have the capability to rock and recline, by the nature of their design. A first type of chair that rocks and reclines has a conventional design in which a seat with connected legs is attached to a pair of curved rails. An example of this type of rocking-reclining chair is shown in U.S. Pat. No. 763,667 issued to Hokans. The chair disclosed by Hokans follows the conventional design by having a pair of rocking rails attached to the legs of a standard chair. Hokans' chair allows the user to rock and recline, but its design has been adapted from a conventional chair and does not address the nature and essence of a rocker. By adding runners to a conventional chair, one alters its use without considering possible side effects. While the chair of Hokans lessens the liklihood of falling backwards compared with other chairs of this type having shorter rails, the possibility still exists. Sheehan et al. in U.S. Pat. No. 4,786,105 shows a modified form of this first type of rocking-reclining chair in which a tubular metal frame forms the rails and support structure.

Rocking chairs of this first type have the disadvantage of having abrupt edges, which may pose a safety hazard, especially to small children. Another disadvantage is seen when the rocking chair is leaning backwards. As one leans back in such a chair, the weight of the person is shifted from the seat to the back section of the chair and the back section of the rails, thus setting up a force couple. This couple may create large sheer stresses in the chair elements which could lead to the failure of the chair, resulting in the possibility of this chair type to tip over backwards.

A second type of rocking-reclining chair has a fixed base coupled to a seat by means of a spring. This type of rocking-reclining chair is exemplified by U.S. Pat. No. 4,522,444 to Pollock and U.S. Pat. No. 4,674,795 to Nelson. These two patents show a chair having a seat that is supported by a flexible frame which allows for rocking-reclining actions. A characteristic of this second type of rocking chair is that by its design an increased force is required to further recline the chair, thus limiting the degree to which the chair may comfortably recline.

A third type of rocking-reclining chair is known as a knock-down type of construction. This third type of rocking chair is formed of a plurality of individual pieces which are adapted to be interfit with each other to provide a complete assembly. Some examples of this knock-downtype of rocker are U.S. Pat. No. 3,909,064 to Payne and Gambello and U.S. Pat. No. 3,460,866 to Kessel. While this type allows the rocking-reclining chair to be disassembled for shipment and storage, it also requires a great deal of assembly and has a number of connections, which must be fastened. In this type of rocker, the aesthetic appearance is restricted to more bulky, heavy-looking furniture, as this is essential to provide sufficient surface to attach the various pieces together.

A fourth type of rocking-reclining chair has a molded outer contour to the seat giving it a rocking or reclininng surface. A weight is located within the chair for upright stability. An example of this type of chair may be found in U.S. Pat. No. 4,109,960 to Stinchfield. Such a chair is highly desirable for persons who find it comfortable and fashionable to sit close to the floor. However, low profile furniture is more difficult to get up from and it does not fit in well with all decors.

Accordingly, besides obvious aesthetic modifications and advantages of the present invention, of a rocking chair with wood-laminated seat and continuous runners, several functional objects and advantages also exist. It is therefore an object of the present invention to simplify construction whereby the invention may be economically manufactured from a minimum number of parts of simple design and which may be assembled with facility. This invention also has the object of providing a rocker in which the main elements can be produced in a variety of materials, limited only by the capacity and capability of the particular material. Another object of the invention to provide a rocking chair which is easy to use and adapted to recline to a wide degree of positions selected by the user. A further object of this invention is to provide a rocker in which its production allows for convenient manufacturing, repeatedly producing the same precise shape. Another object of the invention is to provide a comfortable, rocking-reclining chair which is suitable in appearance for a wide range of decors. This invention will provide both a rocking-reclining chair which is safe, sturdy, and structurally sound, and a novel construction and arrangement of parts whereby people of various body-types are comfortably accomodated. Finally, this rocking chair invention is simple, light-weight, substantial in construction, and thoroughly efficient and practical in use.

SUMMARY OF THE INVENTION

The above objects have been met by a chair having a raised seat with a contour molded surface to conform to a body and maximze the comfort and seating stability of the user, and having a pair of continuous external frame elements that are coupled together to form a support frame for the seating surface. Each of the continuous frame elements, called side frame members, which are connected to one another by internal cross members, form the sides of the chair, armrests, and runners. The seating surface or seating platform fits between the side frame members and is separated from the edges of the side frame members by spacers and is supported off the ground by the internal cross members.

Each of the continuous side frame members have large accurate regions which contact the ground surface and provide the rocking and reclining capabilities of the chair. The side frame members (rockers) are composed of compound radii, made up of multiple arcs. The radius of curvature of each side frame member is relatively constant over a large extent of the arcuate region beginning at the rear of the side frame member. After the long region of rather constant curvature, the radius of curvature of the arcuate region increases forward and upwardly until the side frame member returns to the seat back, forming an armrest, almost parallel to the ground surface. The overall curvature of the arcuate regions is designed such that the center of gravity of a seated person in the chair falls slightly forward the axis of curvature of the arcuate regions. Thus the chair will have a slight tendency to come upright, which tendency is easily overcome by a slight force from the legs or by slight repositioning of the user. Therefore, various sized and shaped persons can use the chair with equal comfort, and only slight movement of the user's arms or legs is needed to initiate rocking or to change positions. No adjustments are required to accomodate a wide range of body sizes.

The above described arcuate side frame members are composed of a ground-engaging region, an arm-supporting region (armrest) and terminates with a region which follows the lines of the seat exactly, thus allowing for a connecton of the side frame members to the internal cross members and the seat. A side frame may be formed by a single member or by multiple pieces, as long as the end result is a smooth continuous frame member.

To support the seat and further strengthen the frame, internal cross members extend within the seat surface and fit into the spacers and side frame members. An advantage of the present invention is that the continuous side frame members provide a sturdy structure. Moreover, the external support frame distributes the load of a user about the frame, thereby providing the present chair with exceptional structural integrity. Another advantage is that the support frame maintains the user comfortably above the floor surface so that the user may easily get in and out of the chair.

The principles of the invention will be further hereinafter discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings, closely related figures have the same number but different alphabetic suffixes.

DETAILED DESCRIPTION OF THE PRESENTLY PREFERRED EMBODIMENTS OF THE INVENTION

Figure 1:
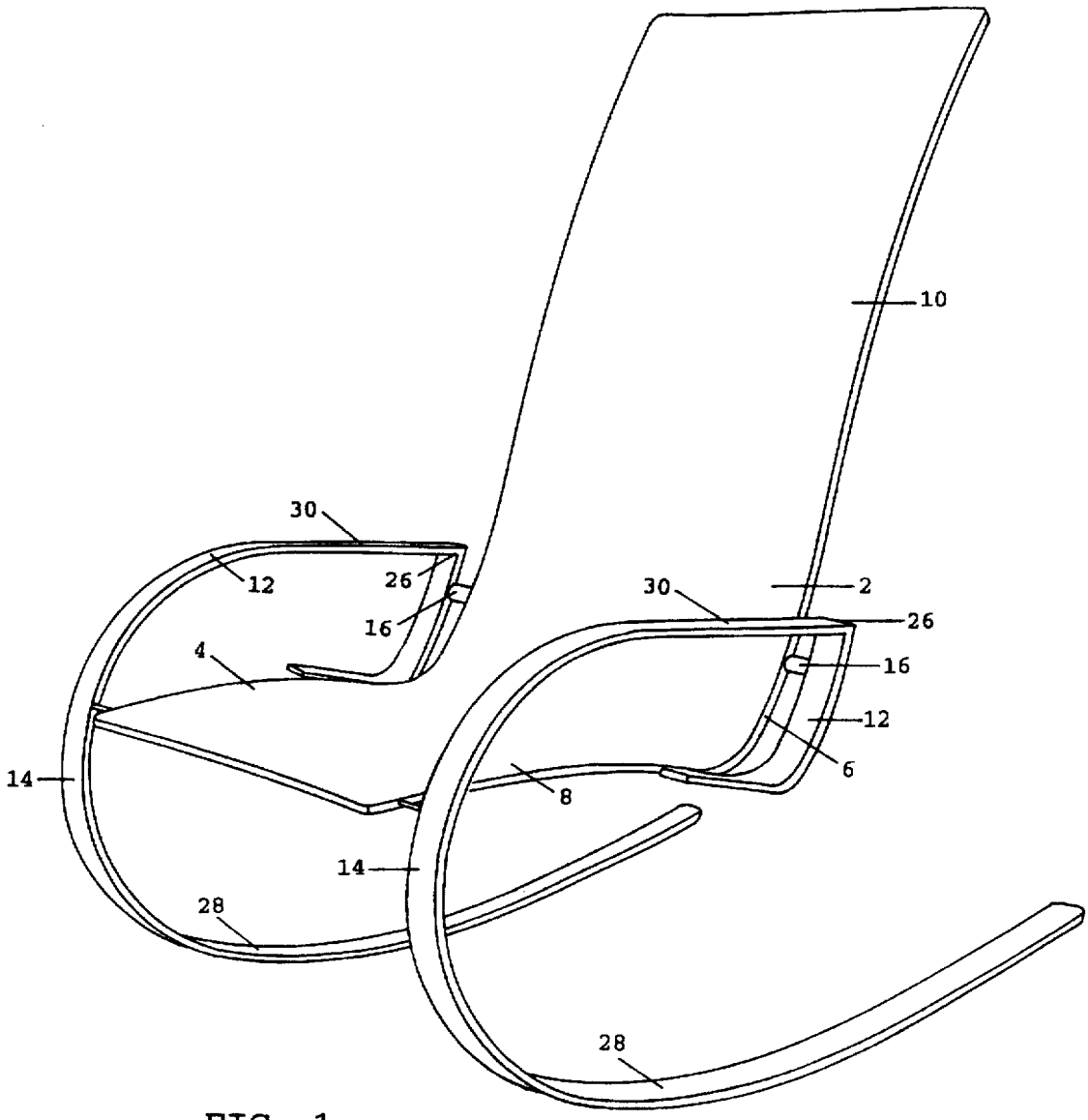
FIG. 1 is a perspective view of a chair in accordance with the present invention.

Referring to FIG. 1, a chair 2 is shown having a seating platform 4 raised and maintained above the ground by an external support frame 12. The external support frame 12 is, in the preferred embodiment, bent or formed metal. However, the support frame 12 can consist of any other material that can take on the desired shape of the frame, and possesses sufficient tensile strength to accomodate a predetermined maximum capacity, such as steel, wood, fiberglass, graphite, carbon fiber, etc. The seating platform 4 has a contour 6 that is formed to conform to the body of a seated person. In the preferred embodiment, the seating platform 4 is constructed of glue-laminated wood plys, which are pressed into the desired form. However, the seating platform 4 may be constructed of any material which has the capacity to take on the desired shape, can be formed without fracturing, and can withstand repeated usage without deforming such as; plastic, fiberglass, steel, aluminum, or any desired flexible membrane supported by a complete rigid frame and may be made by any of the known methods in the art. The contour 6 comprises a smoothly curved seat portion 8 and smoothly curved upright portion 10 which is formed of a single continuous length of material (wood). The upright portion 10 has a sufficient length to provide head and back support to the user, while the seat portion 8 conforms to and supports the seat of the user.

Figure 2:
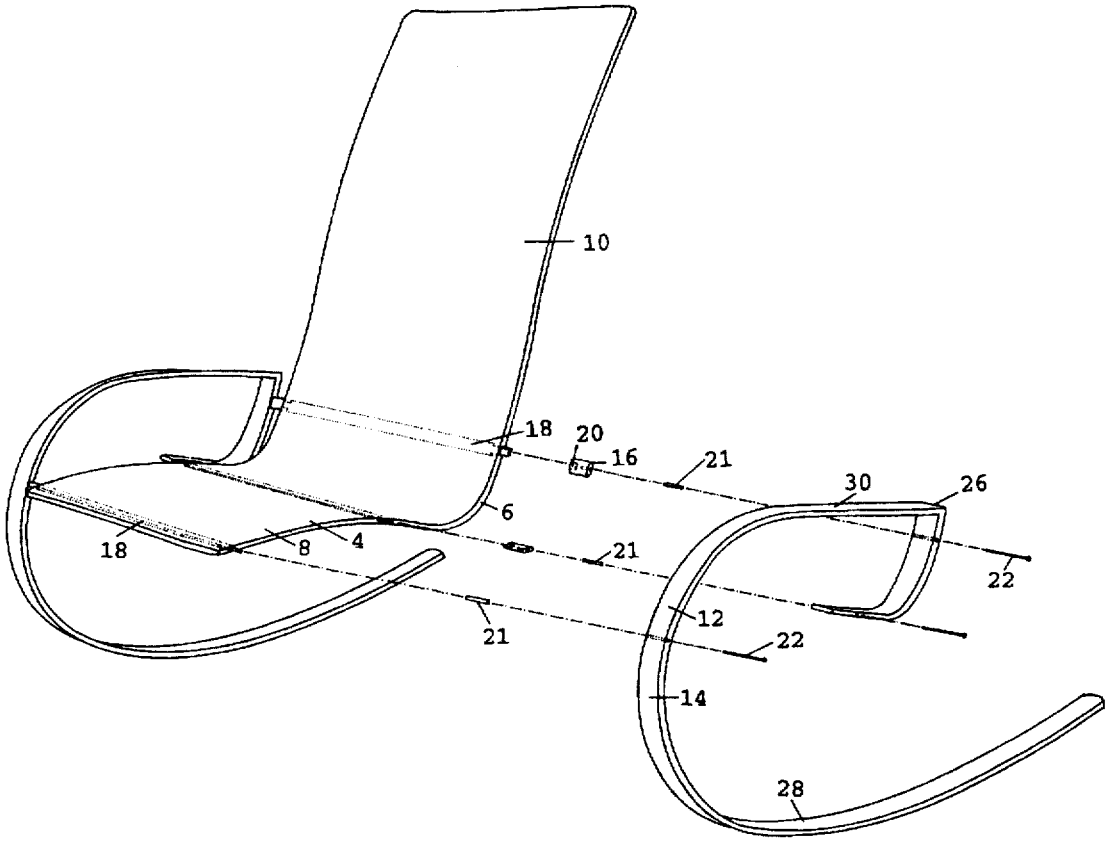
FIG. 2 is an exploded view depicting the various elements and the assembly of the rocking chair.

FIG. 2 illustrates the assembly of the arcuated side frame members 14 to form the support frame 12 of the rocking chair. The side frame members 14 are coupled together by internal cross members and spaced out from the seating platform 4 a distance, giving the seating platform 4 an appearance of floating between the side frame members 14. Another region of the side frame members 14 is the armrests 30. The armests 30 are generally spaced a distance above the seat portion 8 of the seating platform 4. The seating platform 4 sandwiches the metal internal cross members 18 between the laminated plys across the width of the seat. It is seen that the seating platform 4 with protruding metal internal cross members 18 fit securely into slots 20 of spacers 16 and subsequently dowel 21 extending from spacer 16 fit into slots 20 of the side frame members 14. Side frame members 14 and spacer 16 may be disconnected by removing allen bolts 22 from the outer edge of the side frame members 14. The connections between metal internal cross members 18, spacer 16 and side frame members 14 are carefully and precisely machined so the fit is snug and secure. It will be essential that accurate cutting of the slots 20 and accurate postioning of the internal cross members 18 and receiving spacers 16 will result in complete accuracy insofar as alignment is concerned when the respective pieces are assembled. Thus, there will be no skill required in order to provide the proper inclination between the upright portion 10 and the seating portion 8, whereby any purchaser will be able to secure a perfectly accurate arrangement.

Figure 3:
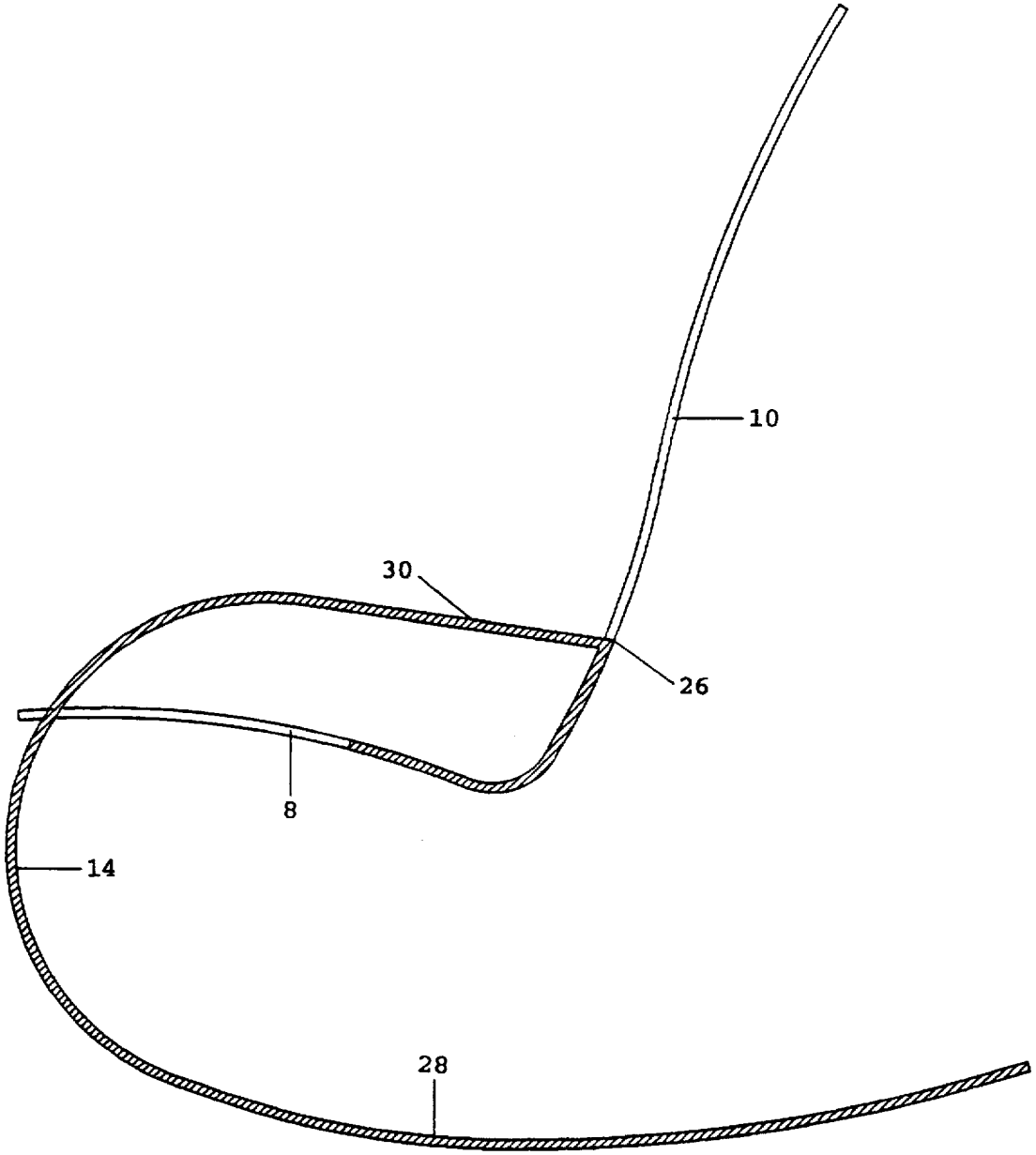
FIG. 3 is a side elevation view of the rocking chair showing the arcuate make up of the side frame members and supported seat.

FIG. 3 illustrates chair 2 in the upright position, as one would find the chair 2 when not in use. It is shown in this drawing that a number of arcuate regions comprise the profile of the side frame members 14. The seat's contour 6 is followed by the upper end portion of side frame member 14 and it is this region where the main internal cross members 18 are connected. The chair 2 is capable of rocking or reclining through the arcuate ground engaging region 28 as desired by the user. This figure illustrates the curvature and contour 6 of side frame members 14 and seating platform 4 which dictate possible limitations of alternate materials.

Experience has shown that close adherence to certain arcs of rocker (the bottom region of each sidepiece) and other dimensions are critical to the precise balance necessary for satisfactory use of this invention. As a result, be it understood several sizes are feasible if the proper sidepiece bottom arc and other dimensions are correctly proportioned.

Figure 4A:
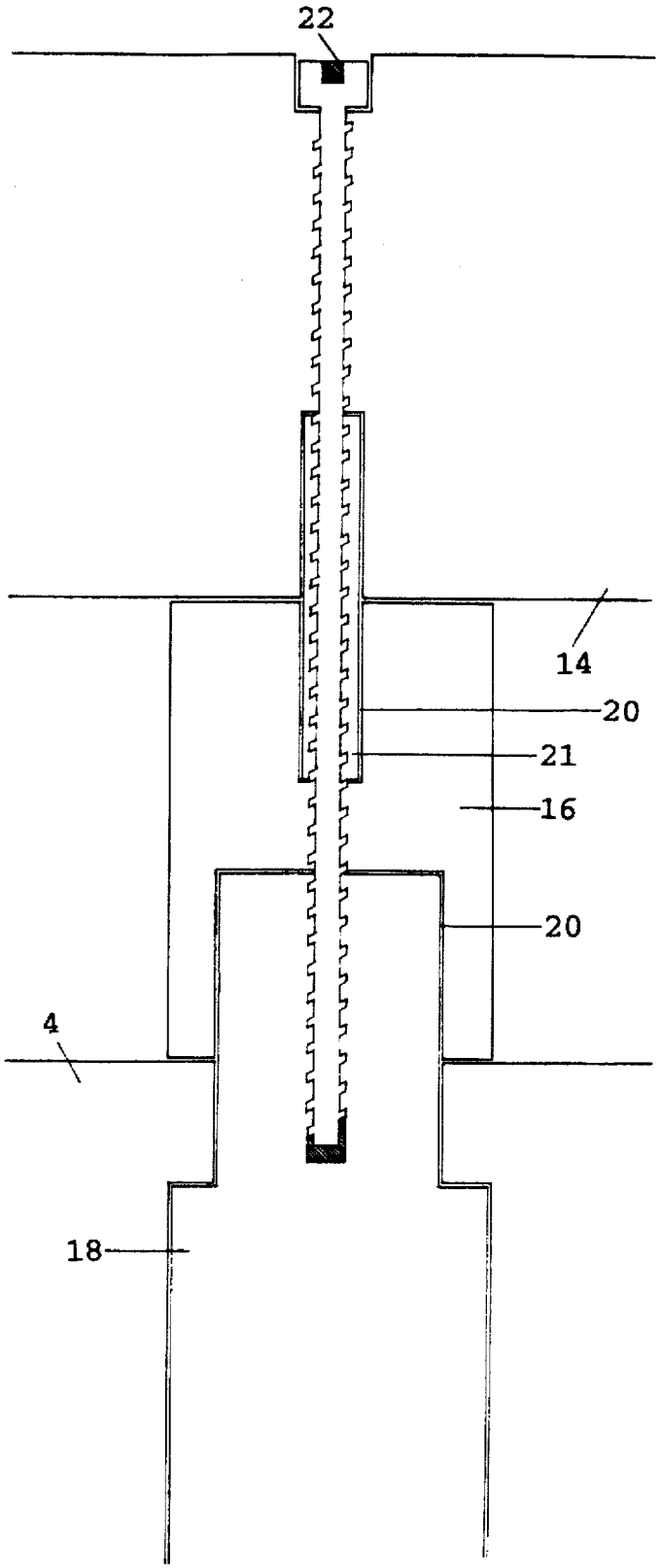
FIG. 4A–4C show section cuts through the spacer and the connection mean of the side frame members to spacer to seat.
Figure 4B:
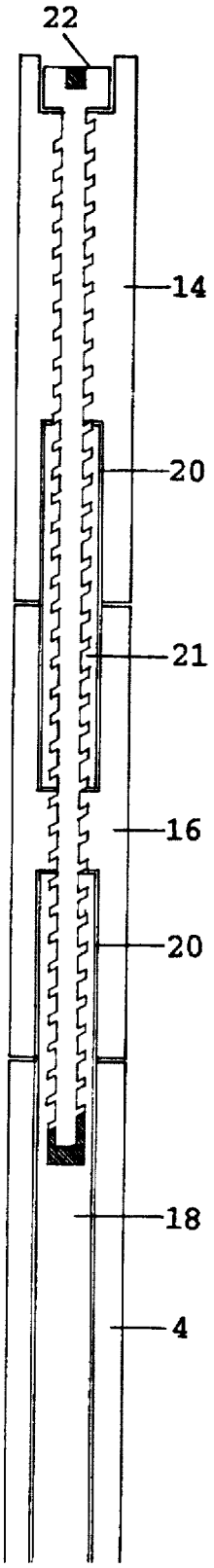
Figure 4C:
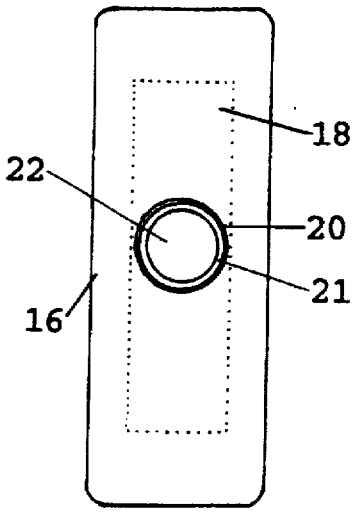

FIG. 4 demonstrates how seating platform 4 connects to spacer 16 and is secured to side frame member 14. The chair 2 is assembled solely by the connection described in these drawings. These connections are located at different places along side frame member 14 at points where it is in alignment with seating platform 4. In this connection, the metal internal cross members 18 are fit into the slots 20 provided in spacers 16, and dowels 21 protruding from spacers 16 are likewise inserted into slots 20 existing in side frame members 14. At the outer edge of side frame members 14, allen bolts 22 are inserted which penetrate through the entire assembly, attaching the side frame member 14 to spacer 16 which in turn is connected to seating platform 4, by means of its attachment to metal internal cross member 18. The connection described must be secured tightly before use to assure a stable, sturdy frame for the rocking motion of chair 2.

Figure 5:
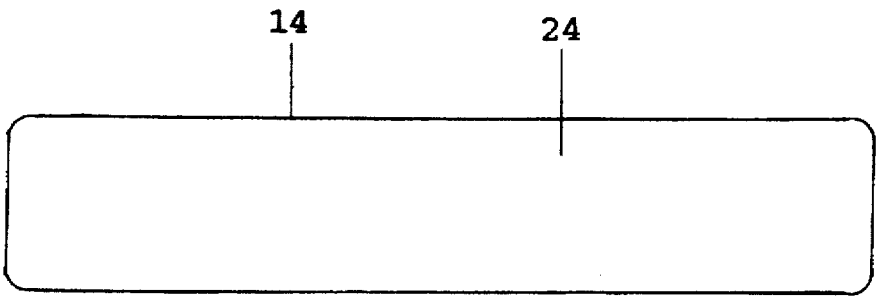
FIG. 5 is a cross section cut through the runner.

Referring now to FIG. 5 it is seen that a cut through side frame member shows the rectangular cross-section with smoothed edges. Side frame members are to be smoothed down on all edges where potentially hazardous corners exist. That is to say they should be smoothed on all of the edges of the rectangular shape 24 along the entire length of side frame members 14 (through the thickness of the frame), likewise at both ends of side frame members 14 there should be smoothing through the width to eliminate sharp ends. Special attention should be paid to smoothing the sharp angular connection 26 at the back of armrest 30.

In view of the above description, taken in conjunction with the accompanying drawings, it is believed that a clear understanding of the construction, operation, and advantages of the improved rocking will be quite apparent to those skilled in this art. A more detailed description is accordingly deemed unnecessary.

It will be understood that various changes and modifications may be made in the above entitled construction which provide the characteristics of this invention without departing from the spirit thereof. Therefore, we do not intend to be limited to the exact embodiment shown and described except as set forth in the appended claims.

We claim:

1. A rocking chair comprising, a unitary seating platform, containing internal cross members, having a (a) contoured back-supporting portion and a seat portion, the seat portion having a fixed forward relation to the back-supporting portion, (b) a support frame for maintaining the seating platform in a ground clearance condition, the support frame having a pair of side frame members spaced apart by the seating platform and spacer elements situated at opposite sides of the seating platform, each side frame member having a continuous outer periphery having a cross member connection region, an arm-supporting region and an arcuate ground-engaging region, the ground-engaging region being coupled to the arm-supporting region in an uninterrupted manner by an intermediate forward segment, each side frame member being formed of identical irregular curves, the ground-engaging region having a forward section of generally constant radius of curvature, the forward and rearward sections of each ground-engaging region combining to define a smooth arcuate rocking means, the side frame members being fixed and fastened to the spacer elements, the to cross members; and the seating platform, (c) the cross member connection region of each side frame member having the same curvature as and being co-extensive with a rear region of said seat portion and a lower region of said back-supporting, (d) the cross member connection region of each side frame member being fastened to one of the spacer elements and one of the cross members in each of the seat and back-supporting portions.

* * * * *